United States Patent [19]

Kimura

[11] 4,134,458

[45] Jan. 16, 1979

[54] SPRINKLER HEAD

[76] Inventor: Katsuhiko Kimura, No. 8, 5-chome, Mandai-nishi, Sumiyoshi-ku, Osaka-shi, Osaka-fu, Japan

[21] Appl. No.: 809,719

[22] Filed: Jun. 24, 1977

[30] Foreign Application Priority Data

Jul. 13, 1976 [JP] Japan ..... 51/83771
Oct. 18, 1976 [JP] Japan ..... 51/127041

[51] Int. Cl.[2] ..... A62C 37/08
[52] U.S. Cl. ..... 169/37; 239/74
[58] Field of Search ..... 169/37–41, 169/90; 239/71, 74; 73/146.3, 146.8, 729, 731

[56] References Cited

U.S. PATENT DOCUMENTS

| | | | |
|---|---|---|---|
| 2,417,449 | 3/1947 | Rubin | 73/146.8 |
| 3,129,689 | 4/1964 | Henderson et al. | 73/146.3 |
| 4,012,960 | 3/1977 | Barbee | 73/729 |

FOREIGN PATENT DOCUMENTS

| | | | |
|---|---|---|---|
| 599160 | 6/1934 | Fed. Rep. of Germany | 169/37 |

*Primary Examiner*—Robert W. Saifer
*Attorney, Agent, or Firm*—Wenderoth, Lind & Ponack

[57] ABSTRACT

An improved sprinkler head provided with a water pressure indicator to permit a visual check to see whether or not it is supplied with water under pressure. The indicator includes a colored indicating element protruding under water pressure.

6 Claims, 4 Drawing Figures

SPRINKLER HEAD

BRIEF SUMMARY OF THE INVENTION

This invention relates to an improved sprinkler head provided with a water pressure indicator.

A sprinkler head is usually mounted on the ceiling of a room or a corridor and, when exposed to temperatures of fire, allows the water under pressure to shower over the fire to extinguish it. Thus, the sprinkler head has to be always supplied with water under pressure. But, it is not always so supplied due to inadvertent failure of pipe connections, leaving the piping disconnected during rebuilding, leaving a valve in the line closed, or other similar causes.

With the conventional sprinkler head, however, it was quite impossible to know from the outside whether or not water under pressure is properly supplied to the head or whether or not it is supplied under appropriate pressure, once it has been mounted on the celing. It was also impossible for constructional reasons to check it by actually heating the sprinkler head to actuate it. This means that the presence or absence of water under pressure is not known until fire actually breaks out. This makes the sprinkler system unreliable.

An object of this invention is to provide an improved sprinkler head which is provided with means for indicating the water pressure, thus making it possible to determine at a glance whether water under pressure is being supplied to the head.

BRIEF DESCRIPTION OF DRAWINGS

Other features and advantages of this invention will become apparent from the following description with reference to the accompanying drawings, in which.

DETAILED DESCRIPTION

Figure 1:
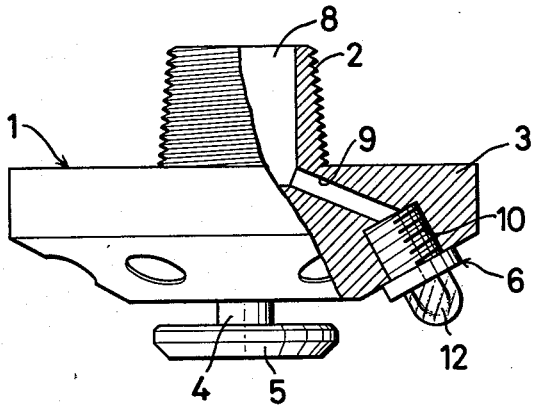
FIG. 1 is a partially cutaway sectional front view of the first embodiment of this invention.

Referring to FIG. 1, numeral 1 designates a sprinkler head which comprises a body 3 having a threaded tubular portion 2 for connection to a water pipe under pressure. The sprinkler head is of conventional construction having an adjusting ring, a spring, a valve cap and guide, a gasket, a lever 4 and a heat sensing plate 5. The body 3 is formed with a water passage 8 in its center.

A water pressure indicator 6 is mounted on the body 3 in such a position that it can be easily seen when the sprinkler head is mounted on the ceiling. The indicator 6 communicates with the water passage 8 through a passage 9. It has a flexible member which protrudes downwardly under the pressure of water being supplied, thus indicating the presence of water under pressure.

Figure 2:
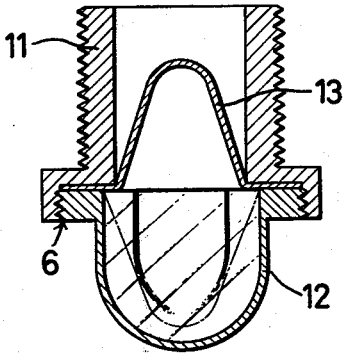
FIG. 2 is a sectional view of one form of a water pressure indicator embodying this invention.

FIG. 2 shows one form of the indicator 6 which includes a threaded tube 11 screwed into a threaded hole 10 formed in the body 3 of the sprinkler head. The central passage in the threaded tube communicates with the passage 9. A transparent cap 12 made of glass or plastic material is screwed into the lower end of the threaded tube 11 with a flexible membrane 13 clamped therebetween in an airtight and watertight manner. A gas (or air) under pressure is sealed in the cap 12 so that the membrane 13 is normally in a concave or hollow position as illustrated by a solid line in FIG. 2 when no water under pressure is supplied to the sprinkler head. The membrane 13 is preferably of a conspicuous color such as red. Under the pressure of the water under pressure, the membrane protrudes into the cap 12 against the pressure of the gas under pressure as shown by a dash line in FIG. 2.

Figure 3:
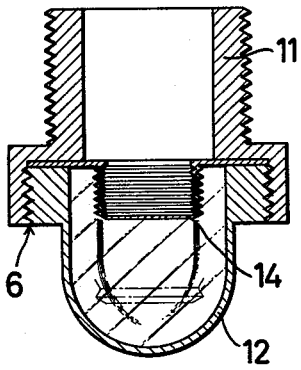
FIG. 3 is a sectional view of another form of a water pressure indicator.

FIG. 3 shows another form of the indicator 6 which uses a metallic expandable diaphragm 14 in the place of the membrane 13 in FIG. 2. The diaphragm 14 is in its collapsed position when there is no water under pressure, but protrudes into the cap 12 in the presence of water under pressure as shown by a dash line in FIG. 3. In this embodiment, no gas under pressure has to be sealed in the cap 12.

Figure 4:
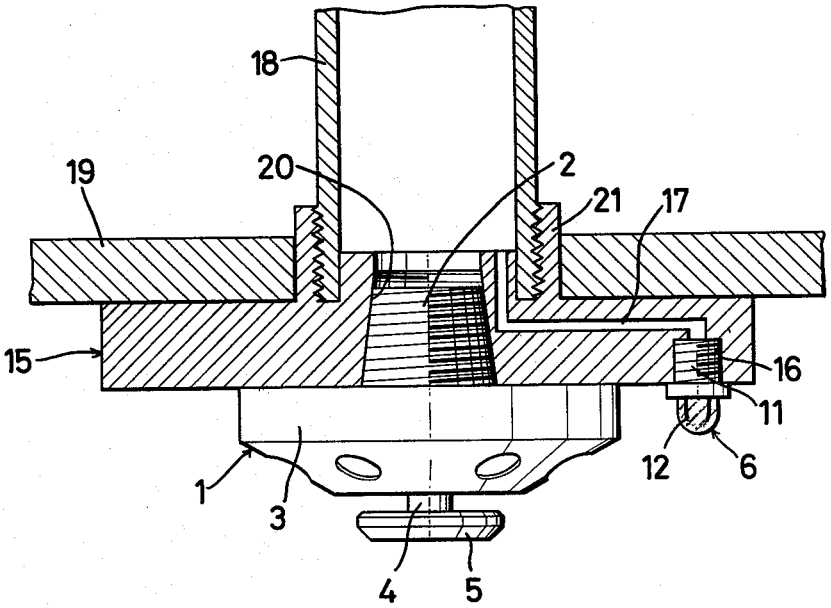
FIG. 4 is a prtially sectional front view of the second embodiment.

FIG. 4 shows another embodiment in which the sprinkler head 1 is mounted on a ceiling 19 through a mounting 15. The threaded tubular portion 2 of the sprinkler head 1 is screwed into a threaded passage 20 formed in the mounting 15, which is screwed on a water supply pipe 18 through its internally threaded flange 21. In this embodiment, the water pressure indicator 6 is screwed into a threaded hole 16 in the mounting 15 instead of in the body 3 to communicate with the water pipe 18 through a passage 17. The indicator 6 is of the same construction as described above.

Also, the water pressure indicator may take still other forms. For example, it may be a lamp connected to an electric circuit closed by water pressure, a membrane or diaphragm having a projection which protrudes out of the body 3 under water pressure, or a Bourdon tube having its tip protruding out of the body under pressure. The cap 12 may also be made to serve as a kind of lens to make more distinguishable the change in position of the membrane or diaphragm.

In actual use, the indicating element 13 (or 14) is in its concave or shrank position so as to be difficult to see from under when no water pressure acts thereon or the pressure is too low to protrude it.

When water under pressure is supplied to the sprinkler head 1, it brings the element 13 (or 14) to its convex or protruded position, thus indicating the presence of water under pressure.

As described above, the water pressure indicator according to this invention makes it possible to know at a glance whether or not the water under pressure is supplied to the sprinkler head. This facilitates the maintenance of a sprinkler system and increases its reliability.

I claim:

1. A sprinkler head comprising a body formed with a water passage, a heat sensing element, and a water pressure indicator mounted on said body to communicate with said water passage, said water pressure indicator having a tube, a cap mounted thereon, and an indicating means mounted watertight therebetween and adapted to protrude toward said cap under water pressure, whereby indicating the presence of water under pressure.

2. A sprinkler head as claimed in claim 1 wherein said indicating means is made of a flexible membrane.

3. A sprinkler head as claimed in claim 1 wherein said indicating means is made of a metallic diaphragm.

4. A sprinkler head as claimed in claim 1 wherein said indicating means is colored in a conspicuous color.

5. A sprinkler head as claimed in claim 1 wherein said cap is transparent.

6. A sprinkler head as claimed in claim 2 wherein a gas under pressure is sealed in said cap to put said indicating means in a collapsed position in the absence of water under pressure.

* * * * *